United States Patent [19]

Heft

[11] Patent Number: 4,528,749

[45] Date of Patent: Jul. 16, 1985

[54] METHOD FOR PRODUCING ELECTRICAL CONNECTION WITH A RIBBON CABLE

[75] Inventor: Josef Heft, Munich, Fed. Rep. of Germany

[73] Assignee: Siemens Aktiengesellschaft, Berlin & Munich, Fed. Rep. of Germany

[21] Appl. No.: 489,007

[22] Filed: Apr. 27, 1983

[30] Foreign Application Priority Data

Jun. 29, 1982 [DE] Fed. Rep. of Germany ..... 3224212

[51] Int. Cl.[3] ..... H01R 43/00

[52] U.S. Cl. ..... 29/858; 339/99 R; 339/176 MP

[58] Field of Search ..... 339/97 R, 99 P, 102 R, 339/99 R, 176 MF; 29/858, 855, 856, 857, 883; 264/272.15, 278

[56] References Cited

U.S. PATENT DOCUMENTS 3,444,506 5/1969 Wedekind ..... 339/99 R
3,820,055 6/1974 Huffnagle et al. ..... 339/97 P X
3,994,554 11/1976 Navarro ..... 339/99 R
4,025,141 5/1977 Thelissen .
4,350,409 9/1982 Kato et al. ..... 339/186 M
4,365,857 12/1982 Watanabe et al. ..... 339/176 MP X

FOREIGN PATENT DOCUMENTS 1327302 8/1973 United Kingdom ..... 339/176 MP

*Primary Examiner*—Howard N. Goldberg
*Assistant Examiner*—Carl J. Arbes
*Attorney, Agent, or Firm*—Hill, Van Santen, Steadman & Simpson

[57] ABSTRACT

For the purpose of producing ribbon cable connections a cable section, such as a cable end section, together with its insulation is extrusion-coated in the form of a block having channels extending at right angles relative to the cable. Cut/pinch contacts are impressed into the channels, the contacts contacting the cable leads and their connection sections projecting from the block. The block with the projecting contacts, in the form of pins, blades, contact springs and the like, can be directly employed as a pin, blade or spring strip which is connected to the ribbon cable, or can be employed for such purpose after being latched to an upper connector contact guide portion.

9 Claims, 7 Drawing Figures

METHOD FOR PRODUCING ELECTRICAL CONNECTION WITH A RIBBON CABLE

BACKGROUND OF THE INVENTION

1. Field of the Invention

The present invention relates to a method for producing electrical connection possibilities for a ribbon cable which exhibits conductors extending parallel to one another in one plane and which are united by way of a synthetic insulation surrounding the conductors.

2. Description of the Prior Art

The production of electrical connection possibilities for a ribbon cable is well known in the art. Essentially, a section of the ribbon cable which, in particular, can be an end section of the ribbon cable, is generally placed on a synthetic plate which is provided with receiving slots for cut/pinch contacts (hereinafter, simply "contacts"), cf. U.S. Pat. No. 3,189,863. Such contacts have also been known as insulation piercing contacts, insulation opening contacts and insulation disruption contacts. The contacts themselves are disposed in a further synthetic part of a connector which is pressed against the ribbon cable section resting on the synthetic plate. The contacts, having contact legs which project from the further synthetic part, thereby penetrate the insulation of the ribbon cable with the contact legs or, respectively, their tips, and are then received by the slots of the insulating material plate, whereby, at least, one conductor of the ribbon cable is respectively seated in the contacting slot of a respective contact. In order to thereby guarantee the proper allocation between the contacts and the individual leads of the cable, the insulating material plate is provided with guides both for the ribbon cable and for the synthetic part which contains the contacts. Moreover, the ribbon cable is pinched between these two parts by way of a locking of the insulating material plate to the synthetic part and, by so doing, a strain relief of the contacts is achieved.

SUMMARY OF THE INVENTION

The object of the present invention is to provide a method of the type initially set forth by which the conduction of the connections for a ribbon cable is significantly simplified.

According to the invention, the above object is achieved in that:

(a) the ribbon cable is extrusion-coated in the form of a block with synthetic material at a specific section (for example an end section), whereby the synthetic insulation of the cable is connected to the synthetic material of the extrusion coating;

(b) slot-like channels directed at right angles relative to the course of the cable are kept free in the synthetic block during extrusion coating, the channels being interrupted by the cable; and (c) contacts are pressed into the channels extending from respectively one side, the contacts thereby penetrating the synthetic insulation of the cable with the tips of the contact legs and respectively receiving a cable lead in their contacting slot which is defined by the legs.

A synthetic block communicating with the insulating layer of the cable is advantageously created in this manner, the contacting of the cable leads simultaneously occurring when the synthetic block is equipped with the contacts. As a result, work steps are eliminated and, moreover, the contacts are relieved of forces effective on the cable (strain relief).

Further features of the invention provide that the contacts, which comprise flat stock, are designed oversized in comparsion to the profile of the channels in at least one direction; that the contacts are provided with a connection section projecting out of the synthetic block and, on a case-by-case basis, have the contact section designed as a contact blade, a contact pin or a contact spring; and that, after impression of the contacts, an upper synthetic part at least partially receiving the connection sectons into chambers provided for this purpose is connected to the synthetic block.

By so doing, the contacts are self-retained in the synthetic block so that given, for example, design of the connection sections as contact blades or contact pins, pin or blade strips finished without further steps already exist. Preferably, given design of the connection sections as contact springs, the spring strip is then produced by connecting the upper synthetic part to the synthetic block, whereby catch ledges interacting with the upper part can thereby be provided on the synthetic block during manufacture of the same.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
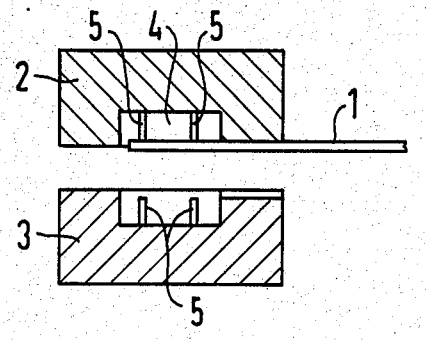
FIGS. 1 and 2 are schematic sectional views of an injection mold for manufacturing the synthetic block in accordance with the present invention.
Figure 2:
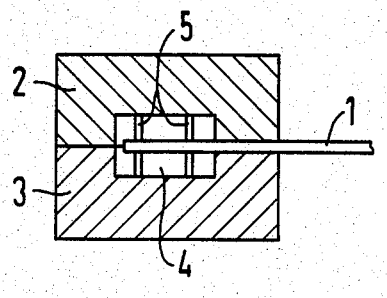

As illustrated in detail in the figures, the connections for a ribbon cable 1 are produced in that the ribbon cable 1 is first placed in an injection mold comprising two halves 2, 3 (FIG. 1), whereby the two halves 2, 3 encompass a cavity 4 which is symmetrical with the ribbon cable 1 and directed at right angles to the extent of the cable. The cable is supported in the cavity 4 by a plurality of pins 5 which cohere with the two halves 2, 3 and which hold the cable 1 inside the cavity 4 in a plane of symmetry of the cavity 4.

The cavity 4 formed by the two halves 2, 3 is then filled with a synthetic compound which, partially dissolving the cable insulation, combines with the cable insulation and then cures.

Figure 3:
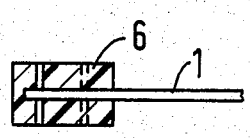
FIG. 3 is a sectional view of a synthetic block injected onto a ribbon cable.
Figure 4:
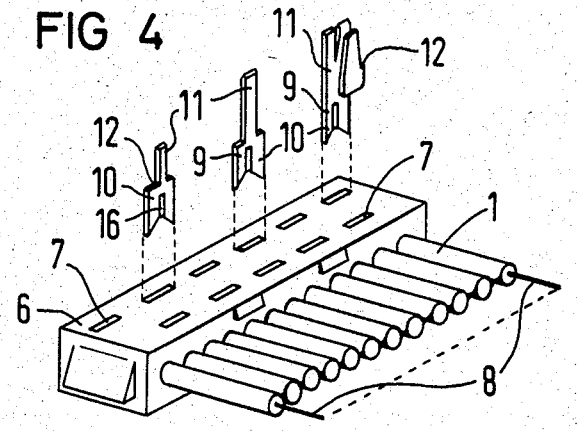
FIG. 4 is an oblique view of a synthetic block injected onto a ribbon cable before being equipped with contacts whose connection sections are optionally designed as contact pins, contact blades or contact springs.

As illustrated in FIG. 3, the cable 1 is thereby embedded in a synthetic block 6 at right angles relative to its extent and is connected thereto. The block 6 is permeated by slot-like channels 7 (FIG. 4) which are respectively assigned to the leads 8 of the cable 1 and which are interrupted by the cable 1 within the block 6.

The channels 7 are designed such that contacts 9 can be impressed into the channels. The contacts 9 which are manufactured of flat stock define a contact limiting slot 16 having two contact legs 10, the contacting slot 16 respectively receiving a lead 8 of the ribbon cable 1. The channels 7 are, of course, formed by the pins 5 which are removed after the synthetic material of the block 6 has set.

Each of the contacts has shoulders 12 which facilitate the impression thereof into the block 6, the shoulders 12 being provided at the transition between the contact legs 10 and a connection section 11 of the contacts 9.

The profile of a channel 7 is dimensioned in the running direction of the ribbon cable 1 and/or at right angles with respect thereto, such that the contacts 9 are disposed in the channels 7 in a press fit manner after they are introduced and impressed through the cable.

Figure 5:
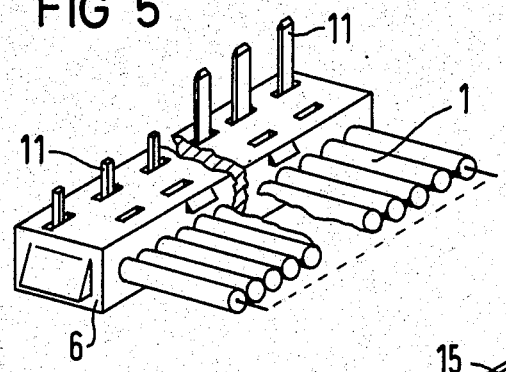
FIG. 5 is an oblique view of a synthetic block equipped with contacts, whereby the connection sections of the contacts are designed as contact pins or, respectively, contact blades and the synthetic block equipped in such a manner forms a contact pin or contact blade strip.
Figure 6:
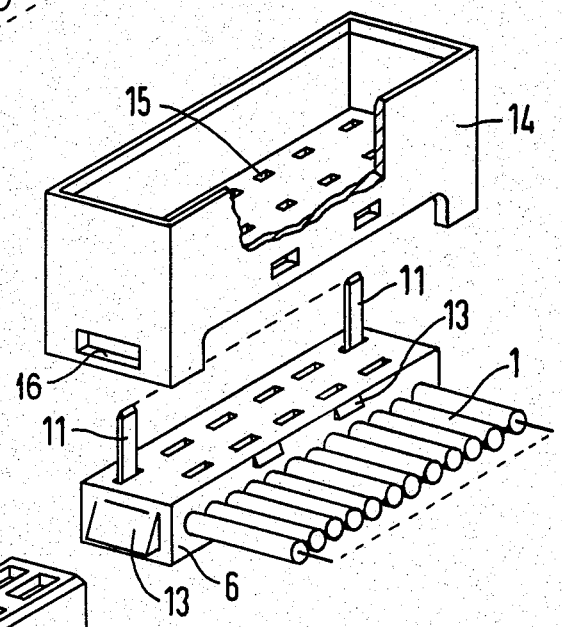
FIGS. 6 and 7 are oblique views of synthetic blocks injected onto respective ribbon cables, each showing the provision of catch ledges and respectively illustrating contact connection sections constructed as contact blades or, respectively, contact springs and a further member for guiding mating contact elements, (here contact springs or, respectively, contact blades) of a mateable connector.
Figure 7:
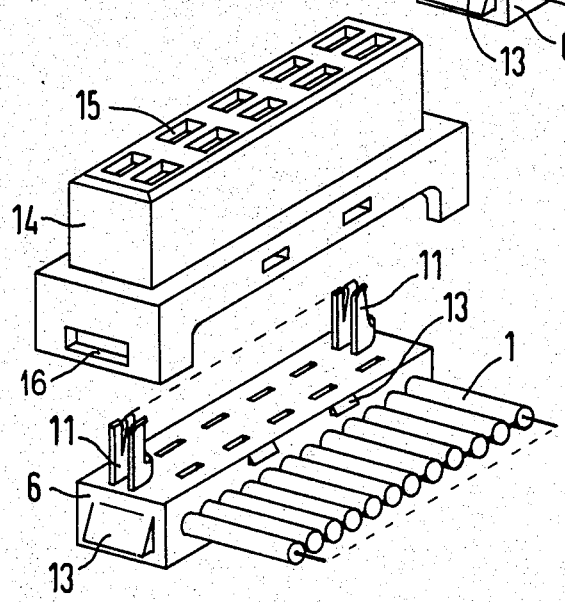

As shown, for example, in FIG. 5, it is therefore possible to employ a synthetic block 6 equipped with contacts and connected to a ribbon cable 1, whereby the connection sections 11 projecting from the block 6 are designed as contact pins or, respectively, contact blades, directly, i.e. without further auxiliaries, as a pin or blade strip. As FIGS. 6 and 7 illustrate, an upper synthetic part 14 can be latched to the block 6 at catch ledges 13 integrally molded therewith for this purpose and which engage surfaces 16. The ledges 13 and the surfaces 16 may be provided, of course, at each end of the connector. The upper synthetic parts 14 are provided with chambers 15 for receiving at least one section of the connection sections 11 of the contacts 9.

The block 6 is thereby augmented to form a blade strip or, respectively, a contact spring strip to which a corresponding mating strip, for example a contact spring strip or, respectively, a contact blade strip, can be connected.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A method of producing electrical connections to a ribbon cable having parallel conductors covered and connected by synthetic insulation comprising the steps of:

(a) placing a section of the ribbon cable in a cavity of a mold extending transverse of the extent of the cable;

(b) filling the cavity with synthetic material while simultaneously maintaining passageways free of the synthetic material at and generally perpendicular to each conductor, the synthetic material dissolving, combining with and then curing with the insulation to form a unitary structure; and (c) inserting cut/pinch contacts having contact-slots defined by a pair of legs into the passageways to receive and contact a respective conductor in a respective slot.

2. The method of claim 1, and further comprising the step of:

(d) selecting at least one cross-dimension of each contact to be oversize with respect to its passageway;

and wherein the step (c) of inserting is further defined as (c1) pressing the contacts into the passageways.

3. The method of claim 1, and further comprising the step of:

(d) forming a connection section on each contact opposite its legs and contact slot.

4. The method of claim 1, and further comprising the step of:

(d) forming a contact blade connection section on each contact opposite its legs and contact slot.

5. The method of claim 1, and further comprising the step of:

(d) forming a contact pin connection section on each contact opposite its legs and contact slot.

6. The method of claim 1, and further comprising the step of:

(d) forming a contact spring connection section on each contact opposite its legs and contact slot.

7. The method of claim 3, and further comprising the steps of:

(e) applying a contact guide part to the unitary structure by simultaneously inserting each contact connection section into a respective chamber in the guide part; and (f) latching the guide part to the unitary structure.

8. The method of claim 1, and further comprising the step of:

(d) forming a latch ledge on the outer surface of the unitary structure contemporaneously with the step (b) of filling.

9. The method of claim 1, wherein the step of filling is further defined as:

(b1) injecting the synthetic material into the cavity.

* * * * *